US005888146A

United States Patent [19]

Raynak

[11] Patent Number: 5,888,146

[45] Date of Patent: Mar. 30, 1999

[54] GOLF SWING TRAINING AND MUSCLE EXERCISING DEVICE

[76] Inventor: Jerome A. Raynak, 3126 Curtis Dr., Flint, Mich. 48507

[21] Appl. No.: 8,712

[22] Filed: Jan. 19, 1998

[51] Int. Cl.[6] ..... A63B 69/36

[52] U.S. Cl. ..... 473/229; 482/112

[58] Field of Search ..... 473/229; 482/111, 482/112, 113

[56] References Cited

U.S. PATENT DOCUMENTS

| | | | |
|---|---|---|---|
| 2,737,432 | 3/1956 | Jenks . | |
| 3,595,583 | 7/1971 | Oppenheimer . | |
| 3,876,212 | 4/1975 | Oppenheimer . | |
| 4,135,714 | 1/1979 | Hughes . | |
| 4,253,663 | 3/1981 | Hughes . | |
| 4,583,740 | 4/1986 | Ohly . | |
| 4,984,801 | 1/1991 | Deback . | |
| 5,125,882 | 6/1992 | La Mothe et al. | 473/229 X |
| 5,188,367 | 2/1993 | Gipe et al. | 473/229 |
| 5,209,481 | 5/1993 | Deback . | |
| 5,221,089 | 6/1993 | Barrett . | |
| 5,284,464 | 2/1994 | Lee et al. | 473/229 X |
| 5,582,551 | 12/1996 | Bursi . | |

OTHER PUBLICATIONS

Article on "The Coach" in the Dec. 1997 issue of Golf Magazine.

*Primary Examiner*—George J. Marlo

*Attorney, Agent, or Firm*—Gifford, Krass, Groh, Sprinkle, Anderson & Citkowski, P.C.

[57] ABSTRACT

A golf swing training and exercising device for developing the muscles of a golfer which are associated with a golf swing. The device includes a housing which is secured at an elevated position above a level ground surface. A resistance generating unit is mounted within the housing and imparts a controlled and adjustable resistance to an elongate member which is pivotally secured to the housing. The elongate member is also both pivotally secured at a first location to the housing and at a second remote location to a grip. The grip is capable of being grasped by the golfer in a golf swing stance and the golfer rotates the grip and elongate member in a first resistive direction corresponding to a back stroke and then in a subsequent and second opposite resistive direction corresponding to a follow through swing.

12 Claims, 5 Drawing Sheets

GOLF SWING TRAINING AND MUSCLE EXERCISING DEVICE

BACKGROUND OF THE INVENTION

1. Field of the Invention

The present invention relates generally to golf swinging apparatuses and devices for developing the physical capabilities of a golfer and, more particularly, to a golf swing training and exercising device for developing the muscle groups of a golfer associated with a golf swing, such muscle training being accomplished with the assistance of a constant resistive force applied to the user during the course of both the backstroke and follow-through swing. The present invention is also useful as a physical therapy device for rehabilitating various injuries and ailments for which exercising of the golfing muscle groups will aid in rehabilitation.

2. Description of the Prior Art

The prior art is well documented with golf swing exercising and training devices for use in developing the muscular capability of a golfer. The purpose behind such devices generally is to improved both the mechanics and amount of force capable of being applied by a golfer during a golf swing.

U.S. Pat. No. 4,984,801, issued to DeBack, teaches a golf swing muscle strengthener device which consists of a structural member attached to a conventional golf club, the member including being clamped to the handle of the club and including a plurality of weights which are suspended from the member so that they are directly below the golfer's grip. U.S. Pat. No. 5,209,481, also issued to DeBack, teaches another type of golf swing strengthening device which incorporates just the handle portion of a golf club and which again includes a selective plurality of weights which are secured to a downwardly extending end of an elongate member.

A further type of golf swing muscle developer is evidenced by U.S. Pat. Nos. 4,135,714 and 4,253,663, both issued to Hughes. The Hughes '714 patent discloses a flexible cord attached to and wound around a spring loaded or spring-retarded pulley mounted to a wall or other stationary vertical support surface. An elongate handle is attached to a free end of the flexible cord remote from the pulley and, upon repetitive use by a golfer, strains and strengthens the muscles of the user. The Huges '663 patent is similar to the '714 disclosure and also teaches a U-shaped mounting bracket design which is capable of being mounted over a horizontal top of a door or other support.

A further type of muscle strengthener device is disclosed in U.S. Pat. No. 3,876,212, issued to Opponheimer, which teaches an arched overhead support which is mounted on rollers so as to be rotated about a fixed axis to selected positions on a supporting surface. A downwardly extending and slidably movable mechanism is secured to the arched overhead support and includes three movably interconnected shafts, the lowermost of which is adapted to be connected to the implement to be swung. A system including hydraulic fluid, valves, electrical sensors and electrical actuators is provided either for detecting movements of the shafts or causing selected movements of the shafts. Unlike, the other cited references, the device of Opponheimer does not appear to disclose any means for establishing or adjusting a resistive force during either the backstroke or follow through swing of the user.

A further type of golf practice apparatus is disclosed in U.S. Pat. No. 3,737,432, issued to Jenks, which is similar to Opponheimer in that it teaches a device capable of positioning the golfer and coordinating the golfer's movements in a controlled manner. Jenks likewise teaches additional structure for positioning the golfer's head during the mechanics of the follow through swing, as well as the golfer's midsection and in addition to providing an elevated platform upon which the golfer stands, however again does not teach or suggest generating a constant and resistive force for developing the golfing muscles of the user.

U.S. Pat. No. 4,583,740, issued to Ohly, teaches a further type of golf swing training device in which the golfing muscles of the user are exercised and which discloses a tubular guide for directing a modified golf club, the club including a disc-shaped and weighted slide which is affixed to the club shaft and slidably engaged within the tubular guide. The weight slide is removable and can be replaced with other varying weights so as to vary the amount of resistive force. Also disclosed in the Golf Training Systems brochure is a swing development device which appears to include an upwardly extending body and, connected thereto, a cord and handle for applying resistive support to the user.

SUMMARY OF THE PRESENT INVENTION

The present invention is a simplified and improved golf swing training and exercising device for developing the muscle groups of a golfer associated with a golf swing. The device includes a generally open housing having at least a vertical planar facing surface and a horizontal base support surface. Mounting bracketry is provided for mounting the housing at an elevated position above a level ground surface, such as to a vertical wall surface, an overhead I-beam, between a top surface of a closed door and an opposing door jamb, and an upper end of an upwardly extending post.

The housing includes a resistance generating unit, such a unit typically being charged with a fluid medium such as a liquid/hydraulic fluid or a pneumatic/gaseous fluid. The resistance generating unit typically incorporates a piston and cylinder assembly within which is charged the selected fluid. The purpose of the resistance generating unit is to provide a controlled and continuous level of resistive force to the rotation of an elongated member which is secured to and extends from the housing.

In a first preferred embodiment, the elongate member is secured to and extends from a resistively rotatable shaft which in turn extends directly from the resistance generating unit. The rotatable shaft projecting from the unit is resistively influenced by virtue of being interconnected to a piston in turn mounted within the fluid charged cylinder. In a further preferred embodiment, the elongate member is secured to and extends from a terminal location of the shaft which is in turn rotatably mounted to the housing proximate, but apart from, to the resistance generating unit. A linkage assembly includes a first arm secured in resistively rotatable fashion to an input of the resistance generating unit and a second pivotally connected arm which in turn is pivotally secured at a free end to an elongate and interconnecting member. The elongate interconnecting member further connects at an opposite end to an intermediate location of the shaft apart from the elongate member and, in operation, the resistive force to rotation being applied through the linkage assembly and elongate interconnecting member to the elongate member.

In either embodiment, the elongate member, in addition to being resistively rotatably secured to the resistance generating unit, is also secured to the housing at a first pivotal connection. The elongate member further may be constructed of first and second coaxially mounted and telescoping portions which are interconnected via a coupling, the coupling capable of selectively adjusting and establishing differing overall lengths of the elongate member.

A grip secures to and extends from a remote end of the elongate member at a second and different pivotal connection. The grip preferably includes a gripping material such as is normally found on a like grip mounted to an end of a conventional golf club shaft and is capable of being grasped by a golfer in a conventional golf stance. The golfer is thus capable of rotating the grip and elongate member about the shaft in a first resistive direction corresponding to a back stroke, the golfer subsequently rotating the grip and elongate member in a second opposite and resistive direction corresponding to a follow through swing.

BRIEF DESCRIPTION OF THE DRAWINGS

Reference is now made to the attached drawings, when read in combination with the following specification, wherein like reference numerals refer to like parts throughout the several views, and in which.

DESCRIPTION OF THE PREFERRED EMBODIMENTS

Figure 1:
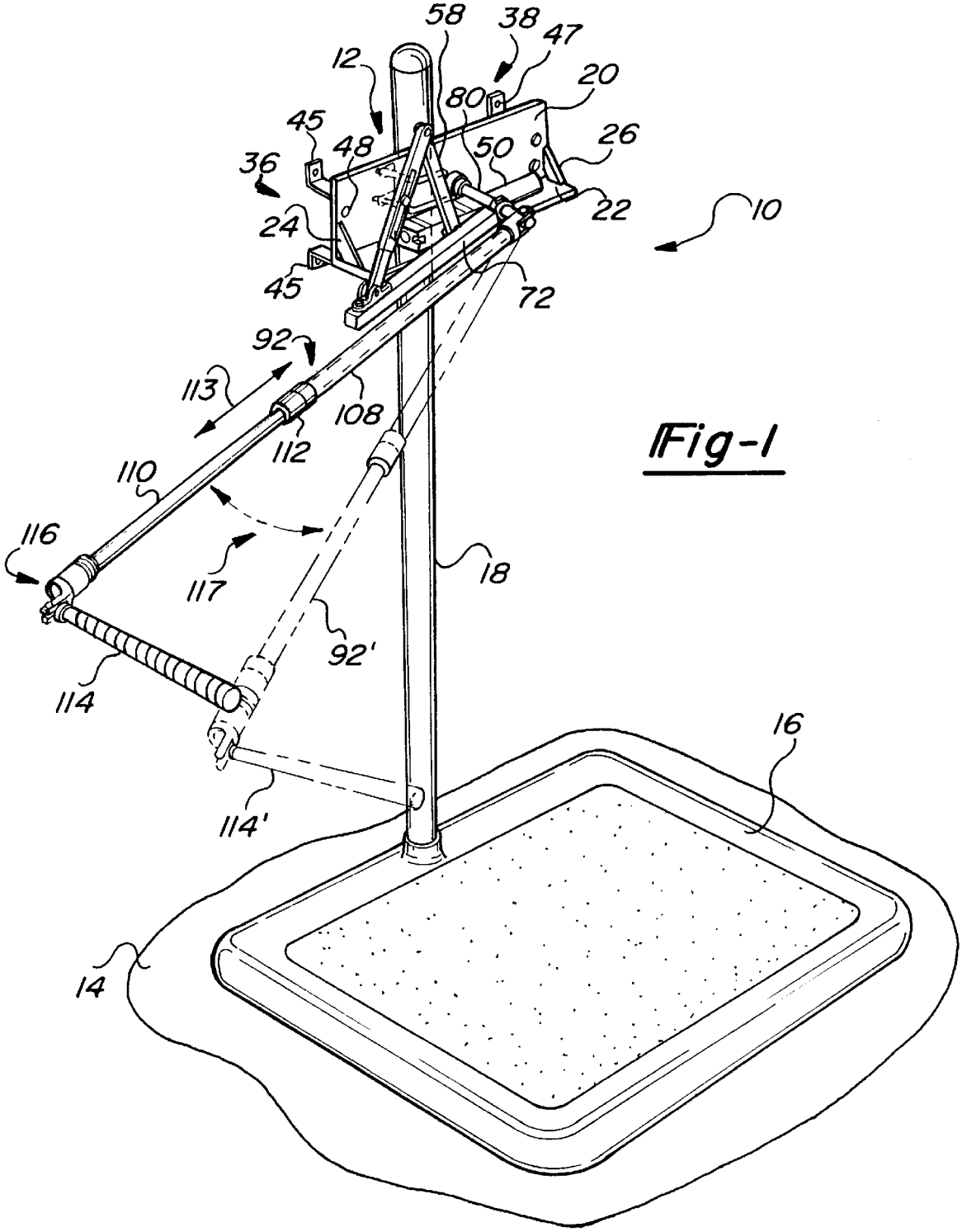
FIG. 1 is a perspective view of the golf swing training and exercising device according to a first embodiment and in which the grip and elongate arm are illustrated in first and second rotatable positions according to the present invention.

Referring to FIG. 1, a golf swing training and exercising device is shown at 10 according to a first embodiment of the present invention for assisting in the development of the muscle groups of a golfer which are associated with a golf swing. The objective of the device 10 according to the present invention is to train and exercise the user so that, during conventional golf play, both the distance and accuracy of a golf ball is increased and the incidence of injury is reduced. This is in large part accomplished by developing the muscles and keeping the used to swing a golf club strong and flexible. The present invention contemplates a training and exercising device which develops these "golf muscles" by employing resistance during both the back stroke and follow through swing of the user. By maintaining the golfing muscles of the user, it is further possible to maximize the power of the swing and to maintain the muscles in a loose condition so as to avoid injury. Further, use of the device of the present invention further facilitates the golfer in establishing a natural arch which is the foundation of an effective swing as well as increasing accuracy due to maximizing club head speed without recklessly swinging at the ball, thus throwing the hitter off balance and missing the ideal strike zone of the ball. The detailed description of the preferred embodiments for accomplishing the training and exercising device of the present invention will now be addressed.

Figure 2:
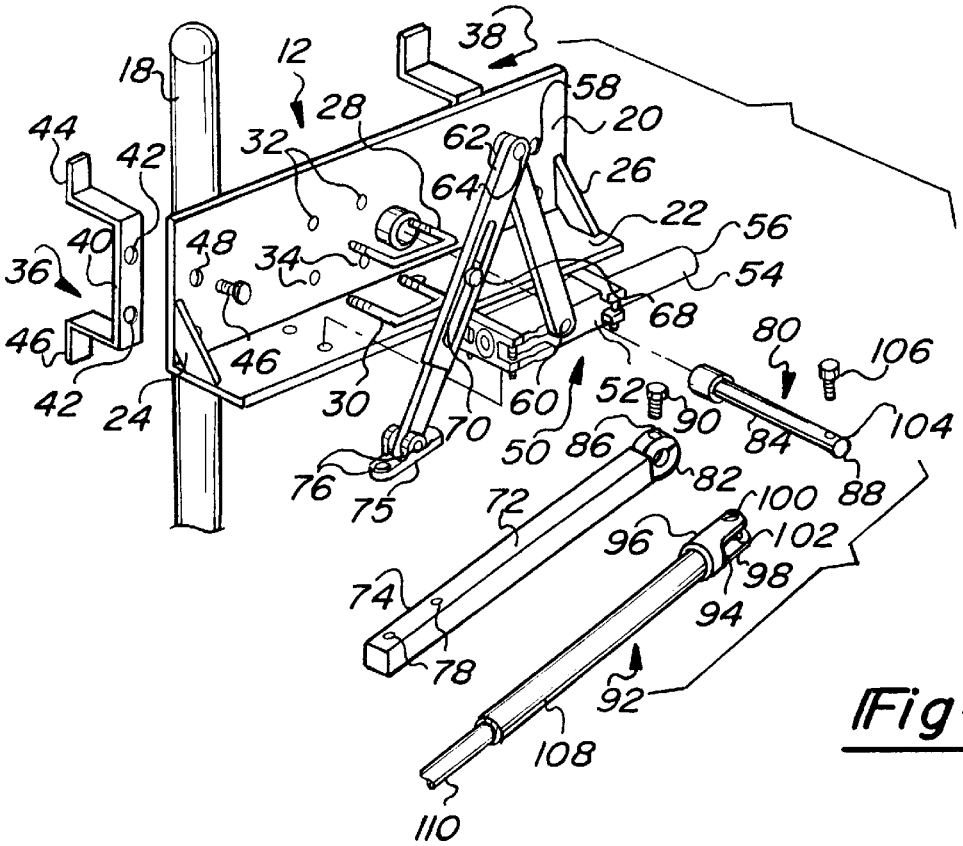
FIG. 2 is an exploded view of the housing, resistance generating unit, rotating shaft, linkage assembly and elongate member according to the first embodiment of the present invention.
Figure 3:
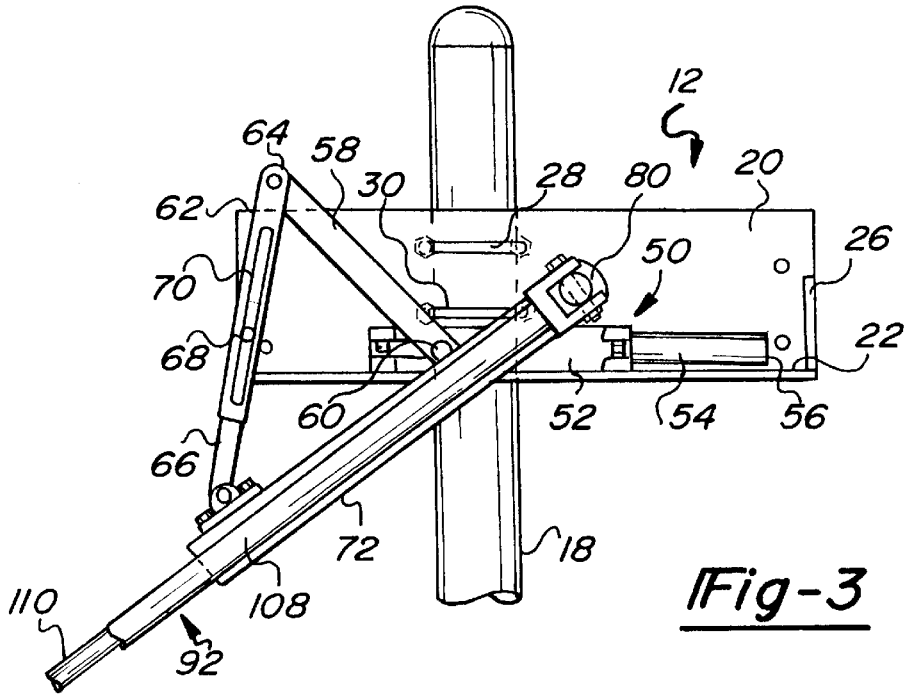
FIG. 3 is a sectional view of the structural components illustrated in exploded fashion in FIG. 2 as well as in perspective in FIG. 1 and showing in more detail the manner in which resistive force is applied to the rotatable motion of the elongate member.

Referring again to FIG. 1, the training and exercising device 10 includes a housing 12 which is mounted at an elevated position above a ground surface 14. In a first preferred variant, the elevated mounting is accomplished by the provision of a planar shaped floor platform 16 upon which a user stands. Extending in vertical and upward fashion from a selected side location of the platform 16 is a post 18 to an upper end of which is secured the housing 12. Referring additionally to FIGS. 2 and 3, the housing 12 is generally open and includes at least a vertical planar facing surface 20 and a horizontal base support surface 22. Reinforcing support between the vertical planar 20 and horizontal base support 22 surfaces is provided for the housing 12 in the form of angled side brackets 24 and 26 which interconnect the surfaces 20 and 22 at opposite ends of the housing 12.

A pair of U-shaped clamps 28 and 30 are also provided with opposing ends of each of the clamps projecting through pairs of apertures 32 and 34 (see FIG. 2) formed through the vertical planar facing surface 20 of the housing. The projecting ends of the clamps 28 and 30 which pass through the surface 20 are secured about the vertical pole 18 at the upper location by means of an additional and interconnecting bolt fastener or the like (not shown).

Alternative mounting means for securing the housing 12 to a vertical wall surface in lieu of a pole is illustrated and includes a pair of mounting brackets 36 and 38. Referring specifically to the mounting bracket 36 which is most clearly illustrated in FIG. 2, it includes a middle portion 40 through which are formed a pair of apertures 42. The bracket 36 also includes distal and oppositely extending ends 44 and 46 for mounting directly to the wall surface (not shown in FIG. 2 however FIG. 1 illustrates apertures 45 and 47 in the opposite extending ends of the brackets 36 and 38, respectively, for mounting to the wall surface). An additional bolt fastener 46 is insertable through an additional aperture 48 formed through the vertical facing surface 20 of the housing 12 in the alternate mounting variant for attaching the mounting bracket 36 and both brackets 36 and 38 are secured in identical fashion both to the housing 12 and the selected vertical wall surface at the desired elevation.

Incorporated within the housing is a resistance generating unit 50. The unit 50 is most commonly a fluid charged cylinder assembly containing a suitable hydraulic/liquid or pneumatic/gaseous fluid and further incorporating an internal piston which is operably connected to the internal cylinder. A common example of such a resistance charged unit is illustrated by a conventional Ingersoll-Rand LCN door closer, and includes Model Series 1000, 2000, 3000 and 4000 as well as various individual model numbers within each series. The resistance unit 50 includes a main body portion 52 and a projecting adjustment portion 54. The main body portion 52 typically incorporates the fluid charged cylinder assembly and the adjustment portion 54 may incorporate a resistance adjustment means such as a spring or other member which is capable of establishing a selective amount of resistive rotational force to be applied by the unit 50. A wrench or suitable tool, not shown, may be applied to an end 56 of the adjustment portion 54 to adjust a resistive force of the unit 50.

Reference is made Ingersoll-Rand LCN Architectural Hardware Brochure, as well as the Installation and Adjustment Instructions which teach the construction of such a resistive force applying device as well as the means for adjusting a selected resistive force. Specific attention is directed to step 3 of the Installation Instructions which disclose the ability to adjust an amount of resistive force to be applied by the resistively charged unit 50. In addition to the conventional door closer assembly identified in the Ingersoll-Rand Brochure and Installation Instructions, it is also contemplated that other types of assemblies and units may also be constructed or acquired for providing a constant and resistive force to a pivotally connected member to be subsequently described, such units also contemplating the provision of other types of mechanical force applications, such as through springs and the like.

Referring again to FIGS. 1, 2, and 3, the resistance generating unit 50 is secured in the first embodiment to the housing 12, specifically atop the horizontal base support surface 22. A linkage assembly includes a first arm 58 which is pivotal secured at a first end in a resistively rotatable fashion to an input 60 of the resistance generating unit. The input 60 again is interconnected to the internal workings of the resistance unit (or closer) 50 and, upon being rotatably actuated, encounters a specified degree of rotative resistance due to the internal piston reacting against the charged fluid. A second arm 62 is pivotally interconnected in end to end fashion with the first arm 58 at 64 and the second arm 62 may in turn include an internally slidable and reduced diameter portion 66 which is secured to the second arm 62 by a pin 68 traveling within an elongate channel 70. The effect of the construction of the second arm 62 is to facilitate the overall rotational motion of the linkage assembly as will be subsequently described.

An elongate and interconnecting member 72 is provided for translating the resistive force from the unit 50 and includes a first end 74 to which a free end 76 of the second arm 62 is pivotally connected. Referring specifically to the exploded view of FIG. 2, a pair of apertures 76 are illustrated formed in the end 74 of the member 72 as well as at 78 in the pivotal end connection 76 of the second arm. A pair of interconnecting bolt fasteners (not shown) are inserted through the overlapping apertures to secure the member 72 to the free end 76 of the second linkage arm 62.

A shaft 80 extends from the vertical planar surface 20 of the housing 12 proximate, but apart from, the resistance generating unit 50 and about a rotatable axis which is parallel to an axis of rotation established between the first arm 58 and the input 60 of the unit 50. The elongate and interconnecting member 72 secures at an opposite end 82 to an intermediate location 84 of the shaft 80. Specifically, referring again to FIG. 2, the opposite end 82 of the member 72 discloses a circular clamping portion with an open center and through which is formed an aperture 86. The clamping portion is fitted over a terminal end 88 of the shaft 80 and slid to the intermediate location 84, at which point a bolt fastener 90 is applied to secure the intermediate member 72 in place. In this fashion, the resistive force of the generating unit 50 is applied directly to the rotatable shaft 80.

An elongate member 92 is secured to and extends from the terminal end 88 of the shaft 80 and, as is best illustrated in the exploded view of FIG. 2, includes a pair of extending mounting flanges 96 and 98 which each possess an aperture 100 and 102. The flanges and apertures are located in alignment over the terminal end 88 of the shaft at which point they further align with an additional aperture 104 formed through the shaft 80. A further fastening bolt 106 is applied though the flanges 96 and 98 located on opposite sides of the shaft 80 and so as to pivotally secure the elongate member 92 to the shaft at a first location.

The elongate member 92 extends in a generally downward fashion from the housing and linkage assembly and includes a first telescoping portion 108 and a second telescoping portion 110. In a further preferred variant, and referring again to FIG. 1, the second telescoping portion 110 is slidable in and out of the first portion 110 and includes a coupling member 112. The coupling member 112 is selectively rotated to engage and disengage the fixed connection between the telescoping portions 108 and 110 and permits an overall length of the elongate member to be adjusted for optimal use as is illustrated by multi-directional arrow 113.

A grip 114 (see FIG. 1) is secured to and extends from an opposite and remote end 116 of the elongate member 92 at a second pivotal connection, the structure for establishing such a pivotal connection being similar to that disclosed by flanges 96 and 98 and apertures 100 and 102 which position on opposite sides of the grip 114 and through the use of a pin which establishes a pivoting axis for the grip 114 to elongate member connection. The grip 114 is preferably covered with a sponge-like or cushioning material identical to that employed on the grip of a conventional golf club shaft and enables a user to achieve optimal effect of the act of swinging a golf club with a specified resistance. As is also shown in FIG. 1, the elongate member 92 can, in addition to being resistively and rotatably actuated relative to the overhead mounted housing 12, be pivoted outwardly from a location illustrated by the member 92 and grip 114 in solid to a further location illustrated in phantom by 92' and 114' and shown by two directional curved arrow 117. The first pivotal connection established between the elongate member and rotatable shaft makes possible this range of additional pivotal motion and such range is necessary for successively establishing the proper golf swing and natural arch.

Figure 4:
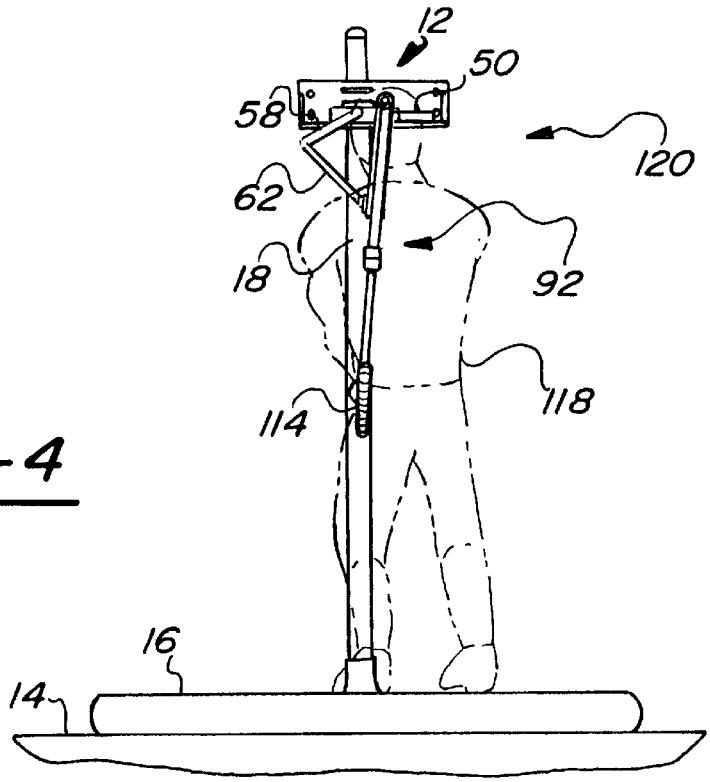
FIG. 4 is a first environmental view illustrating a golfer gripping the golf swing training and exercising device of the first embodiment while in a golfing stance.
Figure 5:
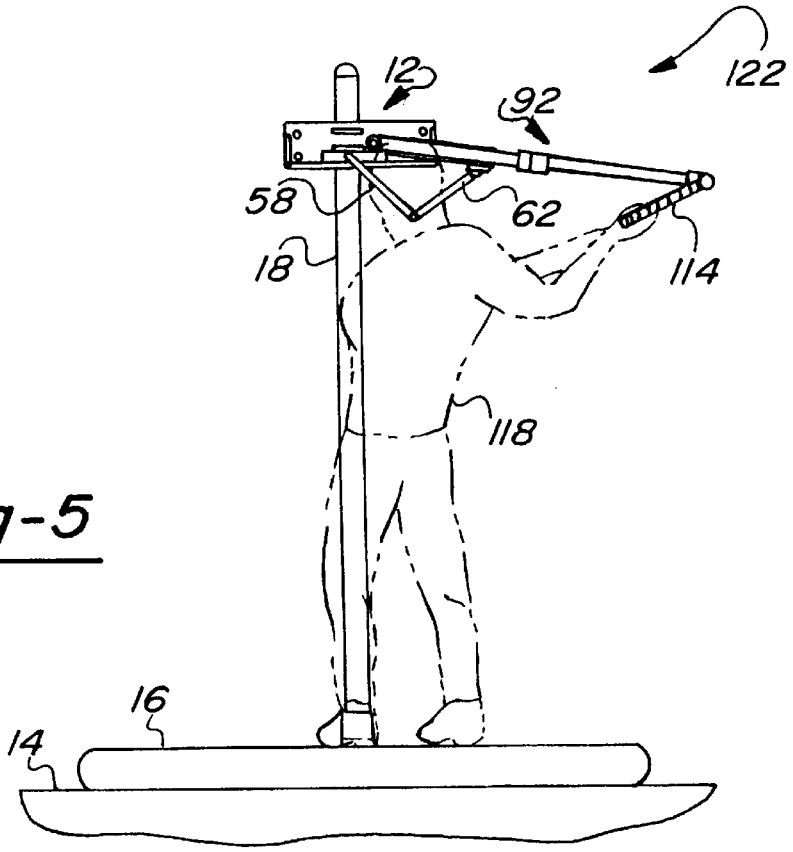
FIG. 5 is a second environmental view similar to that shown in FIG. 4 and further illustrating the golfer rotating the grip and elongate member in a resistive direction corresponding to a back stroke.

Referring to FIGS. 4 and 5 in succession, environmental views are shown of the golf swing training and exercising device which illustrates in phantom a user 118 and first and second positions during the golf stroke. Specifically, a first position 120 is illustrated in FIG. 4 in which the golfer 118 is positioned in a pre-swing stance holding the grip 114 and the elongate member 92 is in a substantially downwardly vertically extending direction. Referring to FIG. 5, a second position 122 is illustrated in which the elongate member 92 is positioned in a rearwardly extending direction in which the elongate member 92 is substantially horizontal relative to the ground surface 14 and the positioning of the grip 114 corresponds substantially to a back stroke location. The advantage of the present invention is that the device can impart a controlled and adjustable force to the golfing muscles of the user both in a first reverse direction back stroke as is illustrated in FIG. 5 as well as a second opposite and resistive direction corresponding to a follow through swing which, although is not also shown, is clearly evident from viewing FIGS. 4 and 5 in combination.

Figure 6:
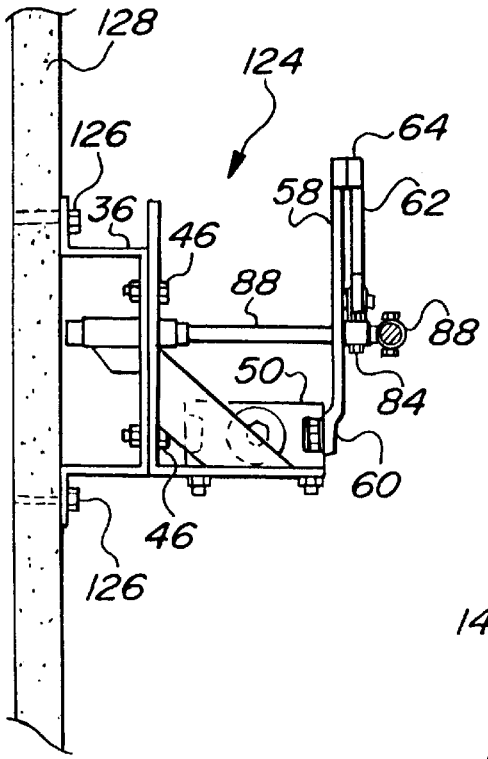
FIG. 6 is a sectional side view illustrating the housing secured to a vertical wall surface in a further variant of the present invention.
Figure 7:
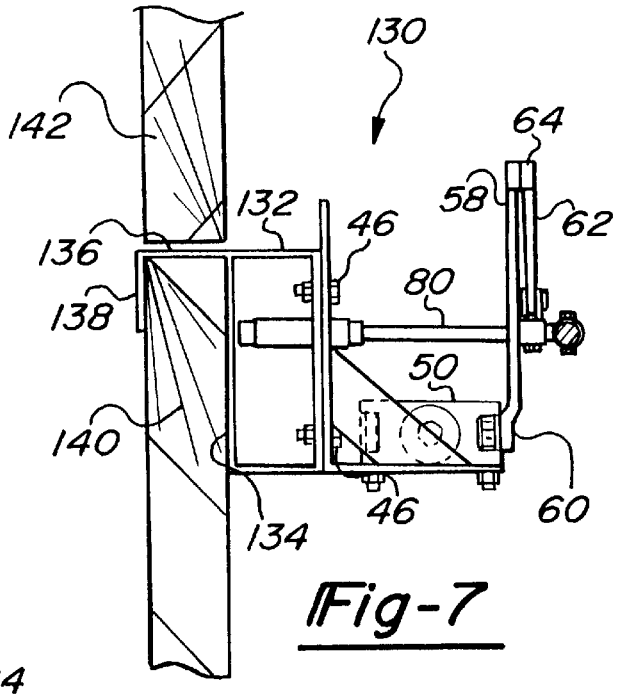
FIG. 7 is a sectional side view illustrating the housing being positioned in restrained fashion between a top surface of a door and an opposing door jamb upon the door being rotated to a closed position.
Figure 8:
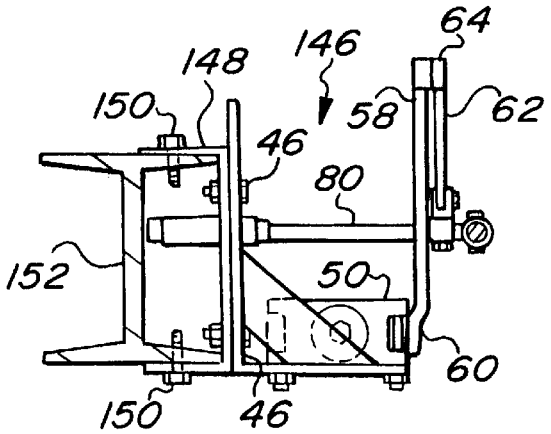
FIG. 8 is a sectional side view illustrating the housing secured to an overhead extending I-beam in a further variant of the present invention.

Referring now to FIGS. 6, 7 and 8, additional variants are illustrated for mounting the housing at the elevated position above the ground surface. Referring first to FIG. 6, a first such variant discloses the mounting brackets (illustrated in side profile by bracket 36 such as was disclosed in FIGS. 1–3) which secures, by virtue of fasteners 126 extending through the distal and extending end portions of the brackets, to a vertical wall surface 128.

Referring to FIG. 7, a further such variant 130 discloses an alternative mounting bracket 132 which extends from a rearward surface of the housing and includes a generally rectangular, internally hollowed and box like shape and particularly includes a rearwardly facing planar surface 134. A positioning and restraining bracket extends from an upper edge of the rectangular box-like portion and the bracket includes a first rearwardly extending planar portion 136 and a second downwardly and L-shaped portion 138. As is clearly viewed in FIG. 7, the positioning and restraining bracket is fitted over a top surface of a door 140 and, upon closing of the door, positionally restrains and fixes the device by virtue of the opposing surface 142 of the upper door jamb.

Referring to FIG. 8, a yet further variant 146 contemplates the mounting of the housing to a conventional overhead extending I-beam. Specifically, a modification 148 of the mounting brackets is illustrated which secures to a rear surface of the housing and includes a pair of vertically oriented fasteners 150 which are inserted through the distal and extending end portions of the brackets and which engage selected abutting flanges of the I-beam 152.

Figure 9:
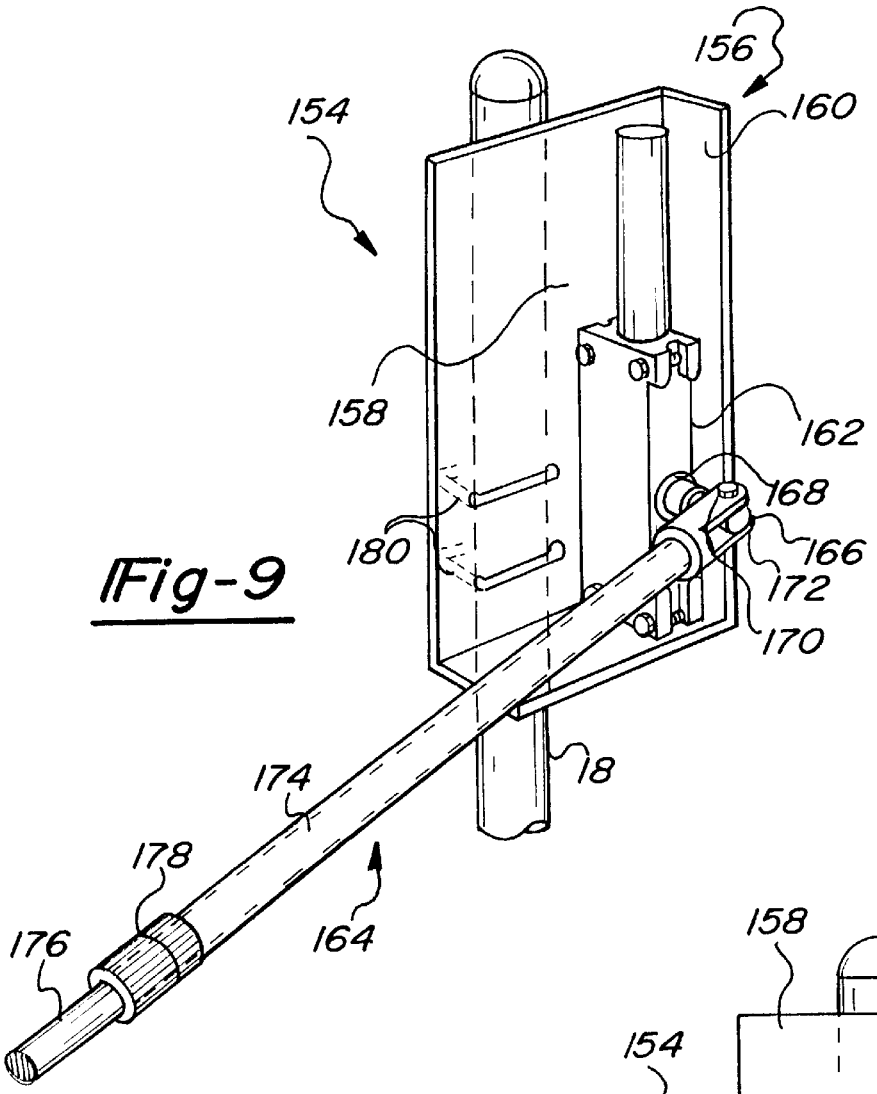
FIG. 9 is a perspective view, in partial section, of a golf swing training and exercising device according to a further preferred embodiment of the present invention.
Figure 10:
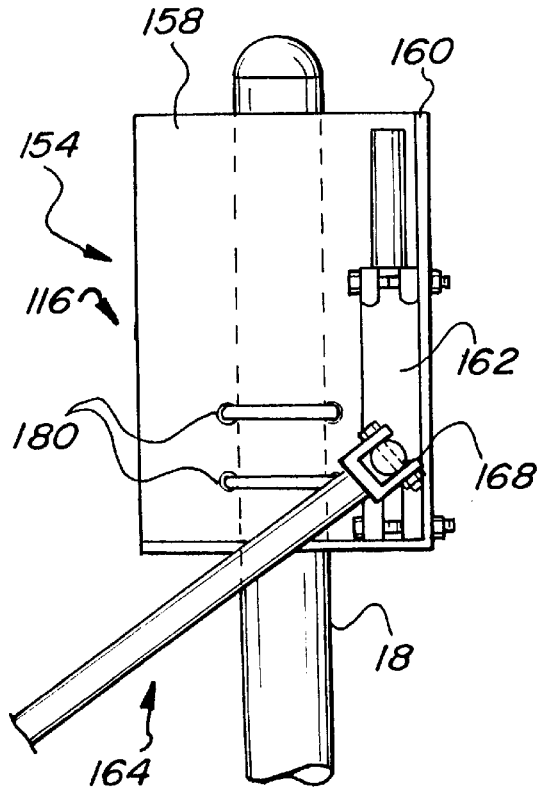
FIG. 10 is a frontal view of the golf swing training and exercising device according to the embodiment of FIG. 9 according to the present invention.

Referring to FIGS. 9 and 10, a further preferred embodiment 154 is shown in section of the training and exercising device according to the present invention. The embodiment 154 is similar in operation to that disclosed in the first embodiment, however it is more simplified in construction as will now be explained. A housing 156 is illustrated as a variation of the housing 12 in the first embodiment and again includes a vertical planar facing surface 158 and a vertical side support surface 160. Mounted to the side support surface 160 in likewise vertical extending fashion is a resistance generating unit 162 identical in every respect to that disclosed in the first embodiment. Accordingly, a repeat of the construction and function of the unit 162 is unnecessary for purposes of the description of FIGS. 9 and 10.

An elongate member 164 (identical in all respects to member 92 of the first embodiment) is secured at connection 166 to input 168 of the resistance unit 162 so that, upon subsequent rotary movement of the elongate member about the axis of the input a desired constant resistive force is applied to the elongate member 164 directly via the input 168 of the unit 162. A pair of spaced apart mounting flanges 170 and 172 extend from the end of the elongate member securing to the unit input and pivotally secure the elongate member in much the same fashion as described in the first embodiment.

As is again illustrated in FIG. 9, the elongate member 164 can include a first telescoping portion 170, a second telescoping portion 172 and an interconnecting and coupling member 174 which actuable to establish a desired overall length to the elongate member. The housing is again illustrated as mounted atop a vertically extending pole 18 as in FIGS. 1–5 with the use of U-clamps 176.

Having described my invention, additional preferred embodiments will become apparent to those skilled in the art to which it pertains without deviating from the scope of the appended claims.

I claim:

1. A golf swing training and exercising device for developing the muscle groups of a golfer which are associated with a golf swing, said device comprising:

a housing;

securing means for mounting said housing at an elevated position above a level ground surface;

said housing including a resistance generating unit, a resistively rotatable shaft being operably connected to and extending from said unit;

an elongate member securing to and extending from said resistively rotatable shaft at a first pivotal connection; and a grip secured to and extending from said elongate member at a second pivotal connection;

said grip capable of being grasped by the golfer in a golf swing stance, the golfer rotating said grip and said elongate member about said shaft in a first resistive direction corresponding to a back stroke, the golfer rotating said grip and said elongate member in a second opposite and resistive direction corresponding to a follow through swing.

2. The golf swing training and exercising device according to claim 1, said resistance generating unit further comprising a fluid charged cylinder, a piston being mounted within said charged cylinder and interconnecting with said resistively rotatable shaft.

3. The golf swing training and exercising device according to claim 2, further comprising adjusting means for selecting a degree of resistance to rotation within said fluid charged cylinder.

4. The golf swing training and exercising device according to claim 2, wherein said fluid charged cylinder is filled with a volume of a hydraulic fluid.

5. The golf swing training and exercising device according to claim 2, wherein said fluid charged cylinder is filled with a volume of pneumatically charged air.

6. The golf swing training and exercising device according to claim 1, said elongate member further comprising a first telescoping portion and a second telescoping portion which is coaxially secured to said first portion via a coupling member, said coupling member permitting said telescoping members to be selectively adjusted to establish a desired overall length of said elongate member.

7. The golf swing training and exercising device according to claim 1, said securing means for mounting said housing further comprising mounting brackets extending from a rear surface of said housing for securing said housing to a vertical wall surface.

8. The golf swing training and exercising device according to claim 1, said securing means for mounting said housing further comprising mounting brackets extending from a rear surface of said housing for securing said housing to a vertically elevated and horizontally extending I-beam.

9. The golf swing training and exercising device according to claim 1, said securing means for mounting said housing further comprising a positioning and restraining bracket extending from a rear surface of said housing for securing said housing between a top surface of a door and an opposing door jamb upon the door being rotated to a closed position.

10. The golf swing training and exercising device according to claim 1, said securing means for mounting said housing further comprising a floor platform and an post secured to and extending upwardly from said floor platform, a pair of U-shaped clamps extending from a rear surface of said housing and being engageable with an upper location of said post to secure said housing in place.

11. A golf swing training and exercising device for developing the muscle groups of a golfer which are associated with a golf swing, said device comprising:

a housing:

securing means for mounting said housing at an elevated position above a level ground surface;

said housing including a fluid charged resistance generating unit;

a linkage assembly including a first arm and a second pivotally connected arm, said first arm being secured in a resistively rotatable fashion to an input of said resistance generating unit;

a shaft extending from said housing proximate to said resistance generating unit and about a rotatable axis which is parallel to an axis of rotation established between said first arm and said resistively rotatable input of said resistance generating unit;

an elongate and interconnecting member securing at one end to a free end of said second pivotally connected arm, said elongate and interconnecting member securing at an opposite end to an intermediate location of said shaft;

an elongate member securing to and extending from a terminal location of said shaft at a first pivotal connection; and a grip secured to and extending from said elongate member at a second pivotal connection;

said grip capable of being grasped by the golfer in a golf swing stance, the golfer rotating said grip and said elongate member about said shaft in a first resistive direction corresponding to a back stroke, said shaft drawing a selected resistance to rotation via said linkage assembly and said interconnecting member, the golfer rotating said grip and said elongate member in a second opposite and resistive direction corresponding to a follow through swing.

12. A golf swing training and exercising device for developing the muscle groups of a golfer which are associated with a golf swing, said device comprising:

a housing;

securing means for mounting said housing at an elevated position above a level ground surface;

said housing including a fluid charged resistance generating unit;

an elongate member and means for securing said elongate member in both a resistive rotatable fashion as well as at a first pivotal connection relative to said housing;

a grip secured to and extending from said elongate member at a second pivotal connection;

said grip capable of being grasped by the golfer in a golf swing stance, the golfer rotating said grip and said elongate member about said shaft in a first resistive direction corresponding to a back stroke, the golfer rotating said grip and said elongate member in a second opposite and resistive direction corresponding to a follow through swing.

* * * * *